United States Patent [19]

Bruni

[11] 4,331,107

[45] May 25, 1982

[54] COOLING OF DIESEL ENGINE PISTONS

[75] Inventor: Ludovico Bruni, Turin, Italy

[73] Assignee: Associated Engineering Italy S.p.A., Turin, Italy

[21] Appl. No.: 158,186

[22] Filed: Jun. 10, 1980

[30] Foreign Application Priority Data

Jun. 12, 1979 [IT] Italy ..... 68258 A/79

[51] Int. Cl.[3] ..... F01P 3/10

[52] U.S. Cl. ..... 123/41.35; 123/193 P

[58] Field of Search ..... 123/41.35, 193 P, 284

[56] References Cited

U.S. PATENT DOCUMENTS

| | | | |
|---|---|---|---|
| 2,772,933 | 12/1956 | Nichols | 123/41.35 |
| 3,323,503 | 6/1967 | Grosshans et al. | 123/41.35 |
| 4,186,692 | 2/1980 | Kawamura et al. | 123/284 |

FOREIGN PATENT DOCUMENTS

| | | | |
|---|---|---|---|
| 1126679 | 3/1962 | Fed. Rep. of Germany | 123/41.35 |
| 1024996 | 4/1953 | France | 123/41.35 |

*Primary Examiner*—Craig R. Feinberg
*Assistant Examiner*—W. R. Wolfe
*Attorney, Agent, or Firm*—Alan H. Levine

[57] ABSTRACT

A Diesel engine piston conventionally has an annular conduit, at the level of the uppermost piston ring, through which lubricating oil circulates. The oil enters and leaves the annular conduit through two longitudinal holes in the piston. According to this invention, a branch conduit extends radially inwardly from the annular conduit to bring oil flow beneath the central part of the piston crown, thereby cooling the latter. The branch conduit is especially useful with a piston having a combustion chamber in its head. The usual discharge hole from the annular conduit is blocked, and a substitute discharge hole, at the end of the branch conduit, opens into the interior of the piston.

1 Claim, 3 Drawing Figures

COOLING OF DIESEL ENGINE PISTONS

It is known that in some Diesel engines cooling of the pistons is obtained by causing circulation of lubricating oil through an annular conduit formed in the head of the piston near the first piston ring.

This known arrangement reduces the temperature of the upper perimetrical region of the piston, and avoids the phenomena of jamming, microseizings of the piston rings, and seizings involving the first collar of the piston.

Cooling of the upper annular periphery of the piston, according to the known technology, does not extend to the central part of the piston crown. Therefore, particularly in pistons which are provided with a Ricardo type combustion chamber, cracks within the chamber often occur and are caused by the high temperatures which form only in the central area of the piston crown.

An object of the present invention is to obviate this serious drawback by cooling by means of lubricating oil, part or the whole area of each piston crown. More specifically, cooling is provided to the part of the crown which is below the Ricardo or other type of cavity or chamber when such cavity or chamber is present.

According to the present invention, there is formed in the head of a piston for a Diesel engine, aligned with and below the Ricardo or other type of cavity or combustion chamber when such is present, an appendix or branch of the annular cooling conduit. The appendix, having any geometric shape, extends from and communicates with the cooling oil annular conduit, and the flow path for the lubricating oil is appropriately modified by means of a suitable relocation of the discharge port thereof.

Additional and particular features of the invention are described in the following specification, with reference to the accompanying drawings, presented only for illustrative purposes.

The drawings illustrate a piston 5 for a Diesel engine provided with a combustion chamber 6 in its head, the combustion chamber in this case being of a Ricardo type. However, the combustion chamber can be of any other known type.

Figure 1:
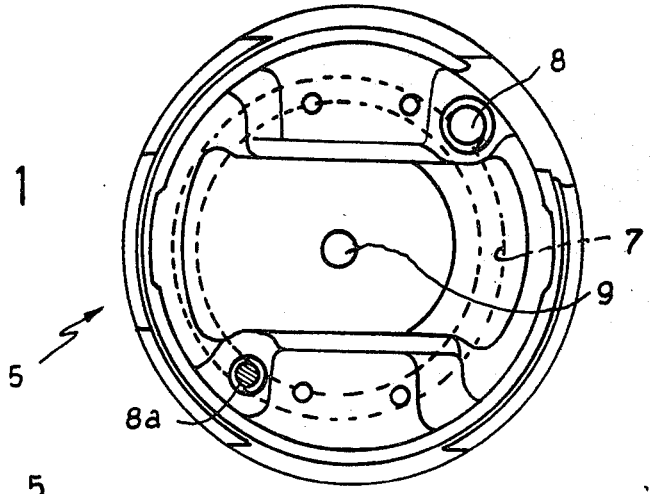
FIG. 1 is a bottom plan view of a piston for a Diesel engine, provided with the improvement according to this invention.

According to the present state of the art, in the top of each piston for a Diesel engine, an annular conduit 7 is formed, as shown in FIG. 1 with dashed lines. A pair of longitudinal holes 8 and 8*a* are provided, for inlet and discharge of the lubricating oil, respectively, the oil circulating within the conduit 7. Holes 8 and 8*a* are arranged in radially opposed locations.

Figure 2:
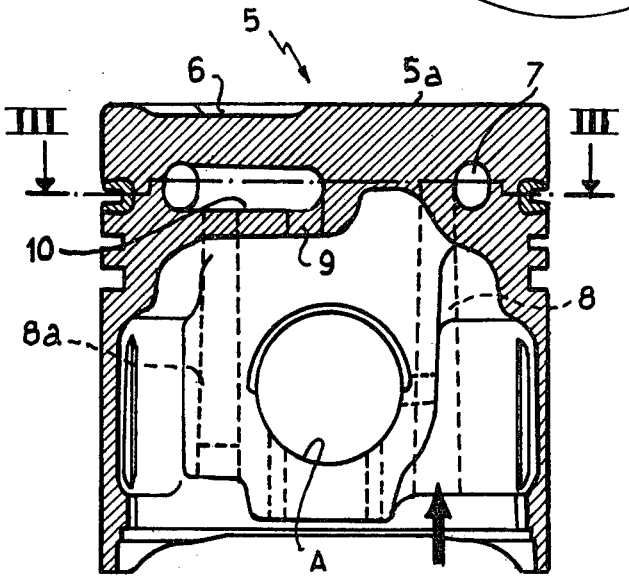
FIG. 2 is a diametral cross-sectional view of the piston.

As has been mentioned, the known expedient just described is effective for cooling the upper annular zone of piston 5, but not so effective for cooling the crown 5*a* (FIG. 2). As a result, damage within the combustion chamber 6 is frequently produced.

Figure 3:
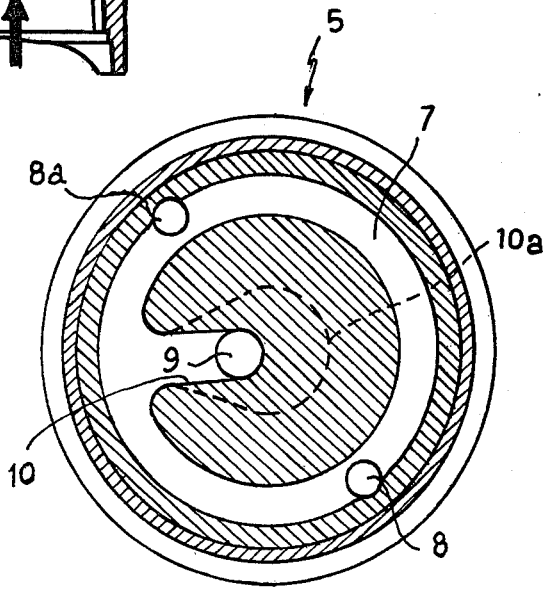
FIG. 3 is a cross-sectional view taken along line III—III of FIG. 2.

According to the present invention, as shown in FIGS. 2 and 3, to the toroidal conduit 7 an appendix or branch 10 is added. Appendix 10 is formed by a radial conduit debouching in the hollow interior of the piston through a discharge hole 9. In addition, the known discharge hole 8*a* (FIG. 1) is closed by a plug. This arrangement causes the cooling oil, admitted into conduit 7 through the longitudinal hole 8 to flow beneath part of the area of crown 5*a* before its downflow through the discharge hole 9. Radial conduit 10, as shown in FIG. 2, is so formed as to be located directly below and in registry with the combustion chamber 6, whereby the lubricating oil produces a substantial reduction of the temperature generated within the chamber.

In FIG. 3, there is indicated in broken lines an enlargement 10*a* of the radial conduit 10. This enlargement may have an outline, extent, and volume compatible with the structural and functional features of the piston, in order to provide the cooling of a larger area of the crown 5*a* of each piston, whether or not the latter is provided with a combustion chamber 6.

Laboratory tests performed on pistons formed according to the present invention, described above, have given important beneficial results concerning the cooling of the combustion chamber 6 and the piston crown.

The invention is not limited to the specific illustrated example herein, but comprises an analogous or equivalent solution.

I claim:

1. A piston for a diesel engine, the piston having a one-piece head portion with an upper surface and an annular periphery, a combustion chamber formed in a part of the upper surface of the piston head, the combustion chamber being offset from the center of the piston head upper surface, an annular conduit within a zone of the piston head portion, an inlet opening through which cooling oil is introduced into the annular conduit, a discharge opening for cooling oil spaced radially inwardly of the annular conduit, and a branch conduit extending radially from the annular conduit directly to the discharge opening, the cross-sectional flow area of the branch conduit being substantially the same as that of the annular conduit, and the branch conduit being located directly below the combustion chamber with its length substantially in registry with the combustion chamber, whereby cooling oil flowing through the branch conduit serves to cool the combustion chamber, the cooling oil flowing through the annular conduit serves to cool an upper area of said annular periphery of the piston.

* * * * *